US005708203A

United States Patent [19]

McKinley et al.

[11] Patent Number: 5,708,203

[45] Date of Patent: Jan. 13, 1998

[54] NEUTRON LOGGING METHOD FOR QUANTITATIVE WELLBORE FLUID ANALYSIS

[75] Inventors: Richard M. McKinley; Walter J. Lamb, both of Houston, Tex.

[73] Assignee: Exxon Production Research Company, Houston, Tex.

[21] Appl. No.: 795,619

[22] Filed: Feb. 5, 1997

Related U.S. Application Data

[60] Provisional application No. 60/011,680 Feb. 15, 1996 and Provisional application No. 60/019,195 Jun. 5, 1996.

[51] Int. Cl.[6] ..... G01V 5/00

[52] U.S. Cl. ..... 73/152.14; 73/152.42; 73/861.04; 250/269.4

[58] Field of Search ..... 73/152.06, 152.08, 73/152.14, 152.18, 152.29, 152.31, 152.42, 861.04; 250/269.3, 269.4, 269.5, 269.6

[56] References Cited

U.S. PATENT DOCUMENTS

| | | | |
|---|---|---|---|
| Re. 28,925 | 8/1976 | Jorden et al. | 73/152.08 |
| 3,993,903 | 11/1976 | Neuman | 250/269.6 |
| 3,993,904 | 11/1976 | Neuman | 250/269.6 |
| 4,076,980 | 2/1978 | Arnold et al. | 73/152.14 |
| 5,205,167 | 4/1993 | Gartner et al. | 73/152.14 |
| 5,375,465 | 12/1994 | Carlson | 73/155 |
| 5,404,752 | 4/1995 | Chace et al. | 73/861.04 |
| 5,528,030 | 6/1996 | Mickael | 250/269.04 |
| 5,552,598 | 9/1996 | Kessler et al. | 250/269.3 |
| 5,561,245 | 10/1996 | Georgi et al. | 73/152.18 |

OTHER PUBLICATIONS

Z. X. Ding, C. W. Jordan, S. G. Wu, and S. B. Nice, "Production Logging in Highly Deviated and Horizontal Wells," Fifteenth European Formation Evaluation Symposium, May 5–7, 1993.

A. M. Bay, P. K. Ablewhite, and S. Barnett, "The Importance of Production Logging in the Monitoring of Production in Horizontal Wells," Fifth International Conference on Horizontal Well Technology, Amsterdam, Jul. 14–16, 1993.

N. R. Carlson and M. J. Davarzani, "Profiling Horizontal Oil–Water Production," SPE 20591, Annual Technical Conference, New Orleans, Sep. 23–26, 1990.

*Primary Examiner*—Ronald L. Biegel
*Attorney, Agent, or Firm*—Marcy M. Lyles

[57] ABSTRACT

A neutron logging tool is used to obtain information about fluids within a wellbore. The well is shut in and a neutron log count rate ($M_{gas}$) is obtained in a portion of the wellbore containing primarily gaseous fluid and a neutron log count rate ($M_{liquid}$) is obtained in a portion of the wellbore containing primarily liquid fluid. Then fluid flow is reestablished in the well and a neutron log count rate ($M_{mix}$) is obtained over a logging interval of interest. Previously obtained calibration data relates ($M_{gas}$), ($M_{liquid}$), and ($M_{mix}$) to relative quantities of gaseous fluid and liquid fluid within the wellbore.

15 Claims, 3 Drawing Sheets

NEUTRON LOGGING METHOD FOR QUANTITATIVE WELLBORE FLUID ANALYSIS

FIELD OF THE INVENTION

This application claims the benefit of U.S. Provisional Application No. 60/011,680, filed Feb. 15, 1996, now abandoned and U.S. Provisional Application No. 60/019,195, filed Jun. 5, 1996, now abandoned.

The present invention relates to production logging for obtaining information about fluids within the production tubulars in a wellbore and, more particularly, to a novel method for quantifying the fluids present in the cross-section of the tubulars at a particular depth.

BACKGROUND OF THE INVENTION

In oil and gas producing operations, there is often a need to identify the fluids present in the cross-section of the production tubulars in a wellbore at a particular depth. For example, it can be particularly important to quantify liquid fluid flow relative to gaseous fluid flow to determine entry points of gas and/or water prior to performing a shut-off workover.

Use of current production logging apparatuses and methods can be problematic for layered phases of gas and liquid, especially when logging highly deviated or horizontal wellbores, which are becoming increasingly more important to capture reserves cost effectively. For example, many commercial tools for taking fluid measurements are so-called line-of-sight tools which measure along the tool body. When flowing fluids layer in the cross-section of production tubulars where such a tool is placed, as usually occurs in highly deviated wellbores, such a tool responds only to the phase in which it is located. Other fluids flowing through the cross-section are not detected.

One current method for assisting in quantifying liquid fluid flow versus gaseous fluid flow in deviated wellbores with a line-of-sight tool is to use a diverting metal-petal basket upstream of the tool. The diverting metal-petal basket comprises a plurality of overlapping metal petals, which are retracted when the basket is inserted into a wellbore and then are expanded when the tool is at the desired depth. This results in an increased local flow velocity and promotes homogenization of segregated fluids downstream in the tool barrel where measurement sondes are located, thus the tool's response better reflects the fluids present in the cross section of the tubulars. However, use of a diverting metal-petal basket in a highly deviated wellbore can be problematic due to solids plugging. The increased flow velocity causes turbulence which can lift and fluidize debris such as drill cuttings, sand, corrosion products, and scale lying on the low side of the wellbore. These solids tend to plug the tool barrel. To remove the plug, the entire tool string must be tripped out of the wellbore and serviced before logging can continue. Tripping costs and increased downtime can add significantly to production logging costs. Additionally, use of the metal-petal basket approach requires time-consuming stationary measurements, is subject to mechanical failure, is restricted to lower flow rates that do not force the tool uphole, and is dependent on tool calibrations in a flow loop, due to leakage past the metal petals.

Another conventional method for quantifying liquid fluid flow versus gaseous fluid flow is the use of pulsed neutron capture or oxygen activation tools in combination with conventional production logging tools. This method relies on coupled analysis techniques to examine multiphase flows. Such a method tends not to be accurate and can be relatively expensive. Separate trips into the wellbore may be required to utilize oxygen activation tools or pulsed neutron capture tools, given the lubricator length needed to contain these long sondes. Multiple trips increase job costs significantly, especially when logging on coiled tubing. In addition, the oxygen activation and pulsed neutron capture tools are difficult to interpret when the flow regime is chaotic turn-over of segregated gas, oil, and water phases, because localized fluid turn-over can mask a true net upward flow.

U.S. Pat. No. 5,375,465, Carlson, describes a method for gas/liquid well profiling, directed toward identifying non-producing intervals, by using calibration data for instruments used for fluid flow rate measurements and fluid density measurements. The patent discusses use of a diverting basket flowmeter for measuring fluid flow rates. The method is disadvantageous for determining entry points of gas and/or water prior to a shut-off workover because of the problems described above with use of the diverting metal-petal basket flowmeter. Additionally, the method requires average values for a set of stationary measurements from two instruments taken over a period of time at each of a plurality of downhole depths. For determining entry points of gas and/or water prior to performing a shut-off workover, it is preferable from a time and expense perspective not to have to take station readings at numerous locations in the wellbore at varying depths.

Recent industry publications which recognize the challenges of production logging in horizontal wells using current commercial techniques include: (i) Z. X. Ding, C. W. Jordan, S. G. Wu, and S. B. Nice, "Production Logging in Highly Deviated and Horizontal Wells," Fifteenth European Formation Evaluation Symposium, May 5–7, 1993; (ii) A. M. Bay, P. K. Ablewhite, and S. Barnett, "The Importance of Production Logging in the Monitoring of Production in Horizontal Wells," Fifth International Conference on Horizontal Well Technology, Amsterdam, Jul. 14–16, 1993; and (iii) N. R. Carlson and M. J. Davarzani, "Profiling Horizontal Oil-Water Production" SPE 20591, Annual Technical Conference, New Orleans, Sep. 23–26, 1990.

Accurate and efficient methods for production logging are needed when logging layered fluid flow to avoid nonproductive workovers. Layered fluid flow is most likely to occur in horizontal and highly deviated wellbores. Disadvantages with current production logging methods are overcome with the present invention, which provides an inexpensive and reliable method for obtaining information about fluids flowing within the production tubulars and, more particularly, for quantifying gaseous fluid flow relative to liquid fluid flow within a logging interval of interest in a wellbore, i.e., in the portion of the wellbore under investigation as a potential shut-off workover location.

SUMMARY OF THE INVENTION

The present invention is a method of quantifying gaseous fluid flow relative to liquid fluid flow within a logging interval of interest in a wellbore using a commercial neutron logging tool, in particular an uncompensated neutron logging tool. Further, the invention is a method of identifying a suitable location in a wellbore for performing a shut-off workover.

Although the commercial uncompensated neutron logging tool is designed for obtaining information about the formation surrounding a wellbore, the method of this invention essentially cancels the effects of the surrounding formation on readings obtained with the tool, i.e., the "background effects", thus providing information about the fluids within the wellbore.

In the method of this invention, neutron log calibration data are obtained by measuring count rates in both gas-filled and liquid-filled pipe covering the range of anticipated sizes of production tubulars used in wells. Additionally, count rates are measured for known mixtures of the gas and the liquid in the pipe. Neutron log count rate ratios of the difference between the gas measurement and the known mixture measurement to the difference between the gas measurement and the liquid measurement are calculated and plotted versus the gas and/or liquid quantities for each known mixture. This "calibration ratio " is insensitive to differences in source strength and minor variations in source/detector spacing.

To obtain neutron log count rates in wellbore fluids, the well is shut in and a neutron logging tool is placed in a portion of the wellbore containing primarily gaseous fluid to obtain a neutron log count rate measurement for gaseous fluid in the wellbore. Also while the well is shut in, the neutron logging tool is placed in a portion of the wellbore containing primarily liquid fluid to obtain a neutron log count rate measurement for liquid fluid. The well is then put on production, and the neutron logging tool is used to obtain a neutron log count rate measurement for flowing fluids over the logging interval of interest. A neutron log count rate ratio of the difference between the downhole gas measurement and the downhole flowing fluid measurement to the difference between the downhole gas measurement and the downhole liquid measurement is calculated and compared to the calibration data to determine the relative quantities of gaseous and liquid fluids in the flowing fluids in the wellbore in the logging interval of interest. Based on the determination, the engineer determines whether measurements in another area of the wellbore are required or whether the logging interval over which measurements were taken is appropriate for performing a workover. For example, if both oil and gas are entering the wellbore in the logging interval, the calibrations can be used to estimate the loss in oil production for a complete shutoff of that interval. With these data, the workover economics can be evaluated using well known engineering techniques. The method of this invention is advantageous because use of the metal-petal basket, stationary measurements, and calibrations in a flow loop are not required.

While the method of this invention is directed toward solving the problems associated with logging layered fluid flow which occurs primarily in horizontal and highly deviated wellbores, where background effects are substantially constant; it is expected that the method may also be applied in vertical and slightly deviated wellbores, where background effects may vary according to depth, provided that any background effects are taken into account and appropriate calibration data are used.

BRIEF DESCRIPTION OF THE DRAWINGS

The present invention and its advantages will be better understood by referring to the following detailed description and the attached drawings in which.

Figure 1:
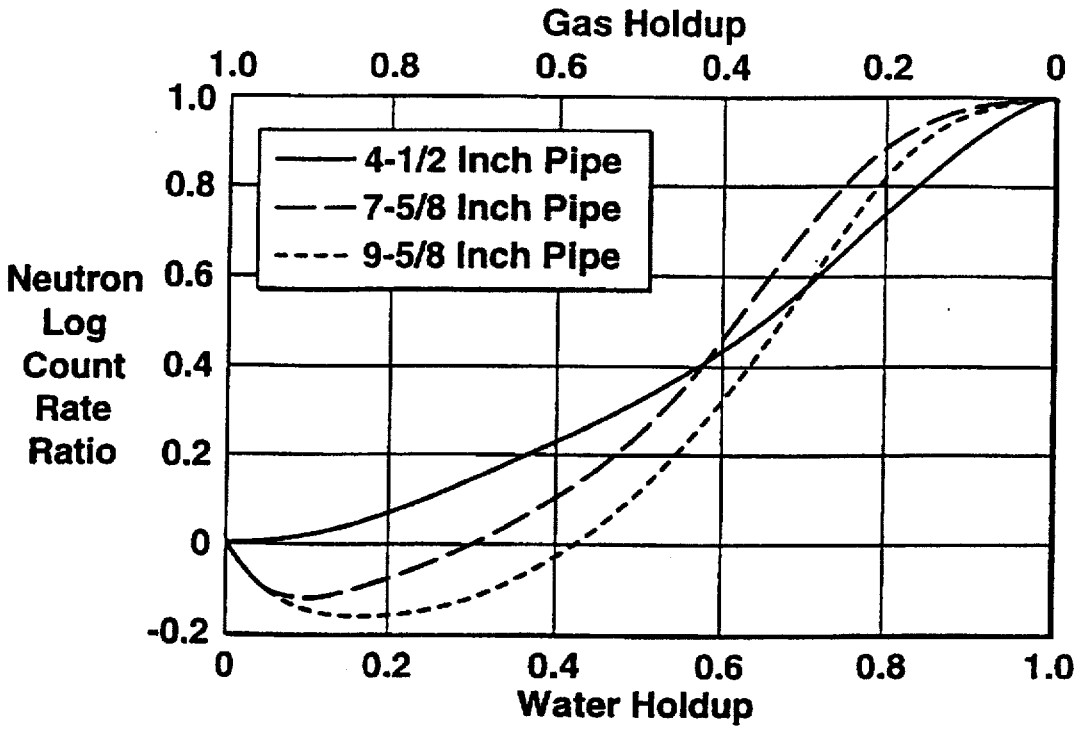
FIG. 1 is a composite plot of the calibration data shown in FIGS. 2, 3, and 4.

While the invention will be described in connection with its preferred embodiments, it will be understood that the invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

The neutron logging tool has been used for about 50 years in the upstream petroleum industry as a formation evaluation tool. The primary application of the tool is in open-hole logging to determine porosity and gas saturation of the formation surrounding a wellbore. Commercial neutron logging tools are intended to probe the formation using count rates of back-scattered neutrons. However, the count rates can be affected by the production tubulars, cement, and fluid in the wellbore. The primary intent of the second-generation compensated neutron log (CNL) was to reduce the influence of the production tubulars, cement, and fluid surrounding the tool during formation logging.

For production logging, often there is a need to identify the fluids present in the cross section of production tubulars at a particular depth. Within the tubulars, the neutron tool should respond primarily to hydrogen density, since hydrogen is an efficient moderator of neutrons. Water and oil have nearly the same hydrogen density and cannot be distinguished with sufficient resolution by the neutron tool. In contrast, the hydrogen density of gas is considerably lower than that of liquid, e.g., water or oil. The intent of the present invention is to take advantage of the conventional (not compensated) neutron logging tool to quantify gas present in a wellbore in order to aid an engineer attempting to find gas entry points prior to performing shut-off workovers.

The present invention uses neutron log calibration data which are obtained by measuring count rates with a neutron logging tool in gas-filled pipe, liquid-filled pipe, and pipe filled with known mixtures of gas and liquid, using pipe sizes covering the range of anticipated production tubular sizes in wells. If calibration data are needed only for a specific field application, then calibration data can be obtained using a pipe which is the same size as the production tubular to be used in the specific field application. The gas used for calibration can be light hydrocarbons, air, or any gas having a hydrogen density comparable to that of light hydrocarbons. The liquid used for calibration can be liquid hydrocarbons, water, or an arbitrary mixture of liquid hydrocarbons and water. It is useful during the calibration measurements to place packing around the fluid-filled pipe to simulate a substantially homogeneous formation surrounding production tubulars downhole. For example, the pipe can be surrounded by water-saturated sand bags or some other material to simulate a formation. For calibration data useful in multi-fluid flow situations where the flow is layered according to density, the pipe should be oriented substantially horizontally during calibration measurements. It is expected that calibration measurements taken in substantially horizontally-oriented pipe should be valid for use in any multi-fluid flow situation where the flow is layered according to density.

Tools useful for obtaining the count rate measurements are a chemical neutron source and detector, and means for centering the source and detector within the pipe. A commercial uncompensated neutron logging tool can be used. Standard commercial source/detector spacing of 17 inches can be utilized, although slight variations in the spacing should not affect the calibration data outside of expected experimental error. The calibration measurements obtained in gas-filled pipe can be referred to as $C_{gas}$; the calibration measurements obtained in liquid-filled pipe can be referred to as $C_{liquid}$; and the calibration measurements obtained in mixed gas/liquid-filled pipe can be referred to as $C_{mix}$.

To normalize the calibration data, the neutron-log count-rate ratio (NLCRR), equal to $(C_{gas}-C_{mix})/(C_{gas}-C_{liquid})$, is plotted versus known liquid and/or known gas content to obtain useful calibration data. FIG. 1, which is further discussed in the Example below, is an example of normalized calibration data. For a pipe containing all gas, the value of the NLCRR is zero. For a pipe containing all liquid, the value of the NLCRR is one. Since, in theory, $C_{gas}>C_{mix}>C_{liquid}$, the value of the NLCRR should always be non-negative. In practice, the value of NLCRR sometimes is negative, as further explained below in reference to the Figures.

Even when the calibration data are obtained using water as the liquid and air as the gas, it is expected that the calibration data will remain valid provided the gas phase under investigation is composed primarily of light hydrocarbons and the liquid phase under investigation is composed primarily of oil or an arbitrary mixture of oil and water. This is because the neutron logging tool (detector) responds primarily to hydrogen density (the hydrogen nucleus is about the same mass as the neutron and serves as an efficient neutron thermalizer) and it is well known that the hydrogen density of water and oil are comparable. In contrast, as previously mentioned, the hydrogen density of gaseous hydrocarbons at typical wellbore temperatures and pressures is considerably lower than that of oil or water.

The calibration data are independent of the source strength and source/detector spacing of the neutron logging tool utilized to take the downhole measurements, provided the downhole gas phase is composed of light hydrocarbons, the downhole liquid phase is oil or an arbitrary mixture of oil and water, and the wellbore temperatures and pressures are within the operating range of the tool. However, at extreme conditions, such as wellbore pressures exceeding 10,000 psi, caution should be exercised when applying the calibrations.

The method of this invention can be utilized during production of hydrocarbons to identify the fluids present in the cross-section of production tubulars at a particular depth as needed, for example, to determine the entry point of gas into the tubulars prior to performing a shut-off workover. When the well is shut in, a count rate measurement, which can be referred to as $M_{gas}$, is obtained in a portion of the wellbore which contains primarily gaseous fluid. For example, in a highly deviated wellbore, commercially available surveying and other techniques can be used to locate the neutron logging tool in a substantially high portion of the wellbore such that the $M_{gas}$ as reading obtained is representative of the gaseous fluid at the depth of interest. A count rate measurement, which can be referred to as $M_{liquid}$, is obtained in a portion of the shut-in well which contains primarily liquid fluid. For example, in a highly deviated wellbore, commercially available techniques can be used to locate the neutron logging tool in a substantially low portion of the wellbore such that the $M_{liquid}$ reading obtained is representative of the liquids at the depth of interest. While fluids are flowing in the wellbore, e.g., during production of oil, the neutron logging tool is located within the logging interval of interest to obtain a count rate measurement, which can be referred to as $M_{mix}$.

The ratio equal to $(M_{gas}-M_{mix})/(M_{gas}-M_{liquid})$ is calculated and compared to the calibration data to determine the relative quantities of gaseous fluid and liquid fluid in the flowing fluids in the logging interval of interest in the wellbore. If the relative quantities indicate that the logging interval is appropriate for performing a workover, then a workover operation is performed.

EXAMPLE

Calibration Procedure

Neutron tool calibrations were performed in 4½ inch, 7⅝ inch, and 9⅝ inch pipe oriented horizontally and containing layers of water and air. Pipe sizes used herein refer to the outer diameter of the pipe, as is standard industry practice. The pipe under investigation was surrounded by sand bags to simulate a substantially homogenous formation. The sand bags were continually wet with a sprinkler so that the water saturation of the sand did not change substantially during a calibration run. A standard logging panel powered by a diesel generator was used when collecting the data. During the calibration, six different chemical neutron sources were used, identified as Source 1, Source 2, Source 3, Source 4, Source 5, and Source 6. Each of these sources had a nominal strength around three Curies (one Curie $=3.7\times10^{10}$ disintegrations/second). The following Table 1 provides additional information regarding the calibrations.

TABLE 1

Test Specifics for Neutron Logger Calibrations

| Neutron Logger | Test Pipes | Data Acquisition |
|---|---|---|
| Gearhart-Owens Cosmo ™ with a tool OD of 1 11/16 inch. Chemical neutron sources (Am—Be) with ~4 MeV neutrons at a nominal 3 Curie strength in a 4½ inch long housing.<br><br>Single thermal neutron detector 13 inches in length.<br><br>Steel shaft between source and detector removed and replaced with steel rods to facilitate source and shield exchange and positioning. Centered in test pipe with metal bow-spring centralizers at both ends and a nonmetallic rubber star wheel near the detector. | 12 foot long carbon steel.<br>4½ in. with 7/32 inch wall.<br>7⅝ in. with 5/16 inch wall.<br>9⅝ in with 5/16 inch wall.<br>Steel plate welded to back end.<br>Plexiglas plate with level graduations on front end to measure water height.<br>Port at top of pipe to pass wireline through.<br>Pipe leveled prior to each measurement.<br>Water-wet sand bags about one foot thick positioned above and below pipe. | Computalog ™ components.<br>Onan ™ electric generator powered by a diesel motor.<br>Digital panel displays neutron count rate and plots a time-averaged rate on a chart recorder.<br>After changing the water height, a waiting period of at least 10 minutes was allotted to eliminate waves.<br>Neutron count rate averaged for 10 minutes at each water level. |

Air was used as the gas and tap water was used as the liquid for the calibration runs. As explained above, it is expected that the calibrations will be valid for wellbores at typical temperatures and pressures containing natural gas and oil or oil/water mixtures.

For these calibration measurements, the fluids were static in the pipes. It is expected that calibration measurements taken with flowing fluid would be valid, although care should be taken to verify the validity of calibration measurements taken with fluid in non-steady state flow.

To normalize the calibration data, the ratio equal to $(C_{gas}-C_{mix})/(C_{gas}-C_{liquid})$ (NLCRR) was plotted versus the volume fraction of the pipe occupied by liquid (liquid holdup) on the lower abscissa and the related volume fraction of the pipe occupied by gas (gas holdup) on the upper abscissa.

The water height in the leveled pipes was converted to liquid holdup using the following engineering expression, which can be derived from known principles.

$$Y_{liquid} = [(h-r)/(\Pi r^2)]\sqrt{2rh-h^2} + (1/\Pi)\sin^{-1}[(h-r)/r] + 1/2,$$

where "$Y_{liquid}$" is the liquid hold up, "h" is the water height in the leveled pipe. and "r" is the pipe radius. Gas holdup is equal to (1-liquid holdup). $Y_{liquid}=Y_{water}$ when the liquid is all water.

Figure 2:
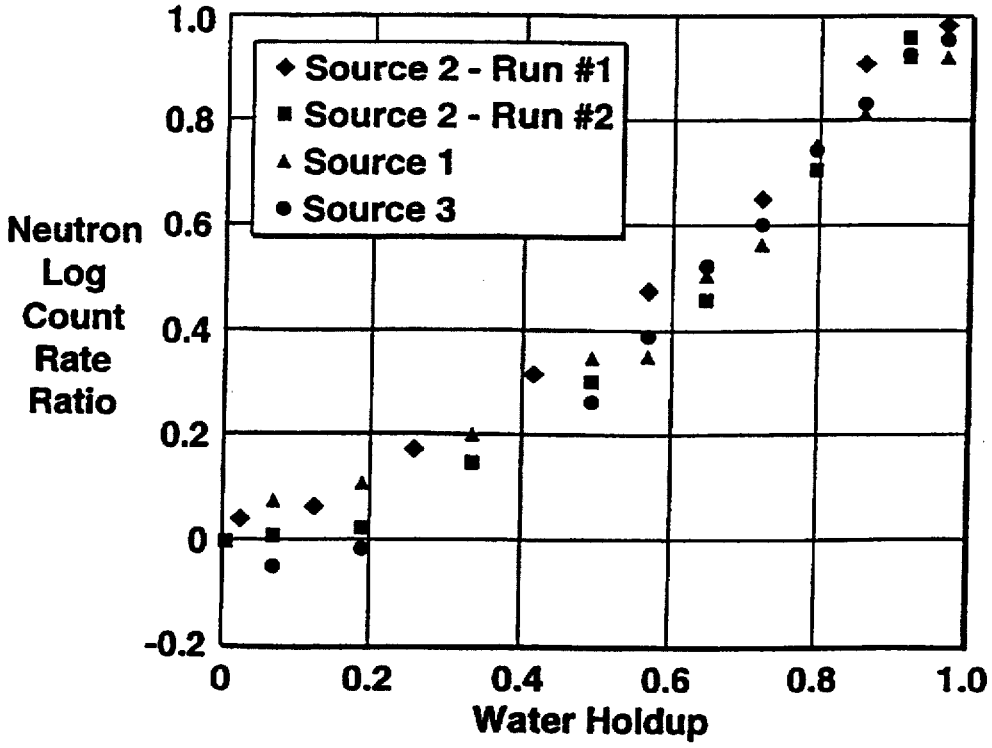
FIG. 2 is a plot of calibration data for 4½ inch pipe, obtained using the method of the present invention with the neutron logging tool centered in the pipe.

The calibration results for the 4½ inch pipe with the neutron logging tool centered in the pipe are shown in FIG. 2. These results were achieved using source/detector spacings from 17 to 20 inches. The slight variance in source/detector spacing did not affect the count rate outside of expected experimental error. The repeat runs on different days with the same neutron source (2) show that the data were reproducible. The use of three different sources demonstrated that the calibration was not dependent on the source.

Figure 3:
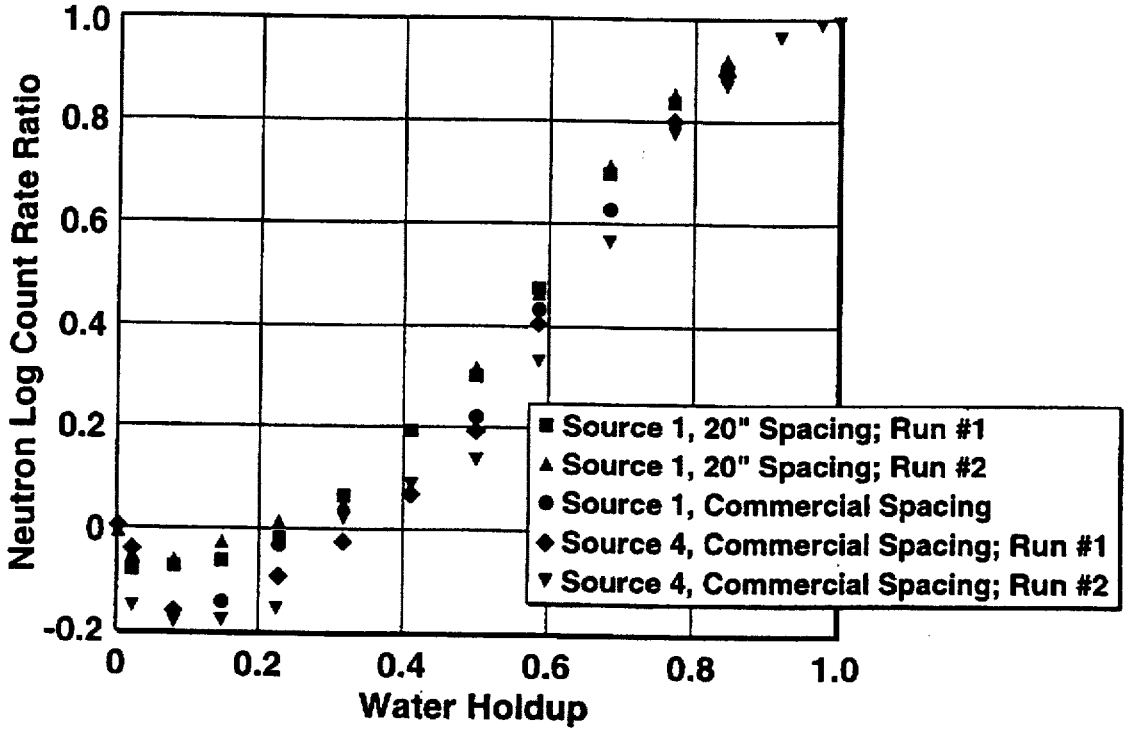
FIG. 3 is a plot of calibration data for 7⅝ inch pipe, obtained using the method of the present invention with the neutron logging tool centered in the pipe.

The calibration results for the 7⅝ inch pipe with the neutron logging tool centered in the pipe are shown in FIG. 3, which shows that an increase in the source/detector spacing from 17 to 20 inches did not affect the count rate outside of the experimental error. For different tool manufacturers, there may be some slight variation in the standard 17-inch commercial source/detector spacing. Based on these data and the expected tolerance in source/detector spacings, it is expected that the calibrations will be valid for all commercial tools.

Figure 4:
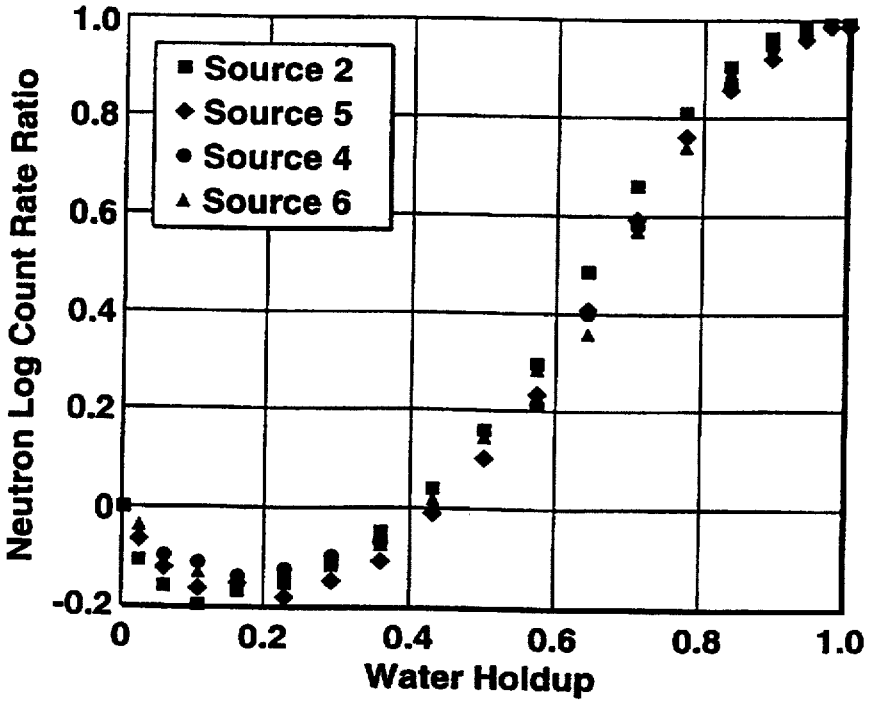
FIG. 4 is a plot of calibration data for 9⅝ inch pipe, obtained using the method of the present invention with the neutron logging tool centered in the pipe.

The calibration results for the 9⅝ inch pipe with the neutron logging tool centered in the pipe are shown in FIG. 4. As is the case for the 4½ and 7⅝ inch pipe, the calibration was reproducible and independent of the neutron source.

Figure 5:
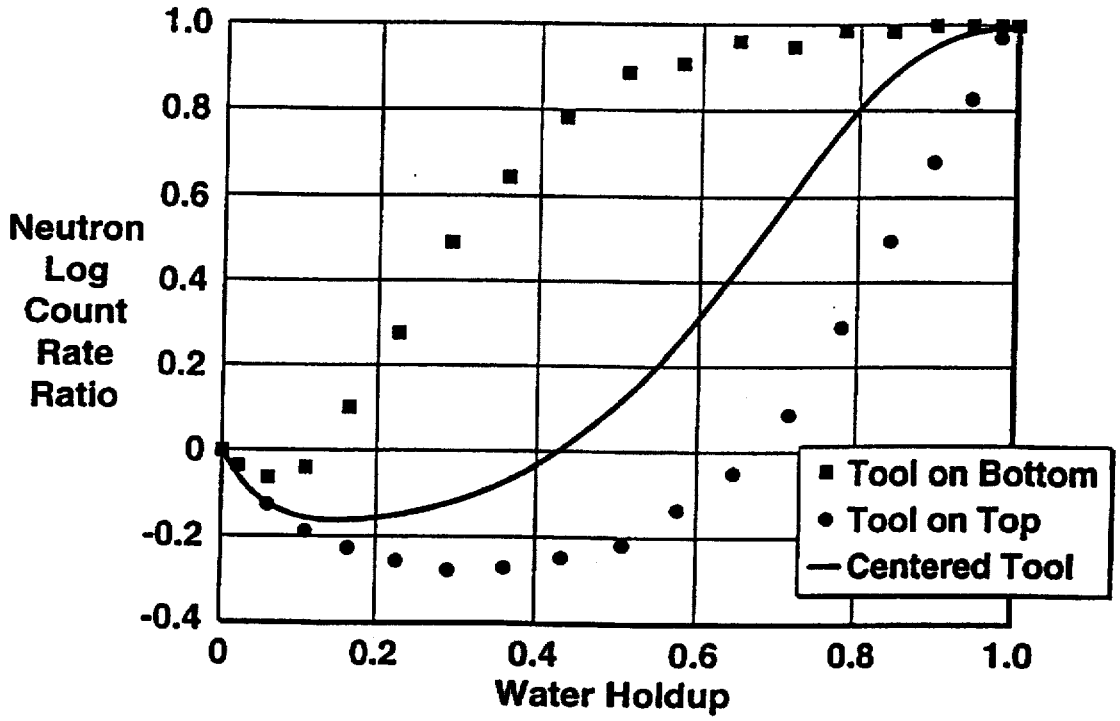
FIG. 5 is a plot of calibration data for 9⅝ inch pipe, obtained using the method of the present invention with the neutron logging tool eccentered at the top of the pipe, eccentered at the bottom of the pipe, and centered in the pipe.

FIG. 5 shows the effect of tool decentralization on the calibration. Tests were performed in 9⅝ inch pipe with the tool eccentered on the bottom and the top of the pipe. As previously noted, the value of the count-rate ratio should always be non-negative, however all of the Figures show some negative data. A negative count-rate ratio means that the count rate (cps) with gas/liquid mixtures exceed the cps in pure air ($C_{mix}>C_{gas}$). A possible explanation for this behavior is scattering of neutrons at the air/water interface. For the centered tool, the negative dips in the calibration plots at low water holdups increase with pipe size. Referring to FIG. 5, the most pronounced dip occurs with the neutron tool in the 9⅝ inch pipe purposely eccentered to the top of the pipe. With the tool lying on the bottom of the horizontal pipe, note that the negative dip at lower $Y_{water}$ is reduced considerably. However above $Y_{water}=0.6$, the calibration curve flattens out. When the tool was positioned at the top of the pipe, the negative dip was greatly exaggerated but the curve did not flatten out at the higher $Y_{water}$. This indicates that tool centralization is desirable to apply the calibrations.

FIG. 1 is a composite calibration plot of the data shown in FIGS. 2 through 4. The lines shown are best-fit sixth-order polynomials through the experimental data points in FIG. 2 (4½ inch pipe), FIG. 3 (7⅝ inch pipe), and FIG. 4 (9⅝ inch pipe).

Field Use

Downhole $M_{gas}$, $M_{liquid}$, and $M_{mix}$ measurements can be taken, as herein described, over a logging interval of interest of a producing well; and the ratio equal to $(M_{gas}-M_{mix})/(M_{gas}-M_{liquid})$ can be calculated and compared to the calibration data to determine the relative quantities of gaseous fluid and liquid fluid in the flowing fluids in the logging interval of interest in the wellbore. If the relative quantities indicate that the logging interval is appropriate for performing a workover, then a workover operation can be performed. In determining whether the relative quantities indicate that the logging interval is appropriate for performing a workover, industry-standard engineering issues, including without limitation, economic considerations and effect on oil flow into the wellbore, should be considered.

Given the turbulence normally associated with gas entries into liquid, gas holdup determinations will likely be more accurate some distance downstream of gas entry. The distance should be adequate to allow the gas to break out of the liquid stream and rise to the high side of the pipe. Due to buoyancy, gas break out should occur fairly rapidly. In addition, it may be beneficial to rely on readings from the most level sections of the wellbore when calculating gas/liquid holdups. Chaotic turnover and/or slugging of the heavier liquid phases in horizontal wellbore troughs can result in wide variation of the gas holdup over time. This can result in time-dependent holdup values that require stationary measurements.

While the method of this invention is directed toward obtaining useful information about fluids within production casing or tubulars in a deviated section of a wellbore, the method can be applied with appropriate background corrections to obtain useful information about fluids within any well, whether the wellbore is vertical, slightly deviated, highly deviated, or horizontal and whether it contains cemented or uncemented production casing, liners, gravel pack screens, or is open hole.

If the method of this invention is used to log fluid flow in a situation in which fluid flow is not layered according to density, such as in slightly deviated or vertical wellbores, sufficient shut-in data should be collected to ensure that background formation effects are not dominating tool response or that any variation in background effect can be accounted for. For such wellbores, calibration data should be obtained in a substantially vertical pipe and the NLCRR set equal to $[\ln(C_{gas}/C_{mix})/\ln(C_{gas}/C_{liquid})]$ Also, the ratio compared to the NLCRR should be set equal to $[\ln(M_{gas}/M_{mix})/\ln(M_{gas}/M_{liquid})]$.

Many modifications and variations besides those specifically mentioned may be made in the techniques mentioned herein without departing substantially from the concept of the present invention. It is expected that good engineering practice will be utilized in practicing the method of the present invention. Accordingly, it should be understood that the forms of the invention described and illustrated herein are only examples, and are not intended as limitations on the scope of the present invention.

What is claimed is:

1. A method of quantifying gaseous fluid flow relative to liquid fluid flow in a portion of a wellbore, said method comprising:

(a) obtaining calibration data which relates for at least one pipe, a volume fraction occupied by a liquid to a normalized neutron log count rate;

(b) while said wellbore is shut in, using a neutron logging tool to measure a neutron log count rate for gaseous fluid ($M_{gas}$) in said portion of said wellbore;

(c) while said wellbore is shut in, using said neutron logging tool to measure a neutron log count rate for liquid fluid ($M_{liquid}$) in said portion of said wellbore;

(d) while fluids are flowing in said wellbore, using said neutron logging tool to measure a neutron log count rate for flowing fluids ($M_{mix}$) in said portion of said wellbore;

(e) determining a neutron log count rate ratio which relates volume fraction of said portion of said wellbore occupied by a liquid to a normalized neutron log count rate; and (f) comparing said neutron log count rate ratio to said calibration data to quantify said gaseous fluid flow relative to said liquid fluid flow in said portion of said wellbore.

2. The method of claim 1 wherein the step of obtaining said calibration data comprises correlating neutron log count rate ratios to relative quantities of said gas and said liquid in said at least one pipe.

3. The method of claim 1 wherein said at least one pipe is oriented substantially horizontal and said fluids flowing in said wellbore are layered according to density.

4. The method of claim 3 wherein the step of obtaining said calibration data comprises:

(a) measuring liquid count rate($C_{liquid}$) with a neutron logging tool in said pipe containing said liquid;

(b) measuring gas count rate ($C_{gas}$) with said neutron logging tool in said pipe containing said gas;

(c) measuring a plurality of mixture count rates ($C_{mix}$) with said neutron logging tool in said pipe for a plurality of known mixtures of said liquid and said gas; and (d) for each said known mixture of said liquid and said gas, determining a neutron log count rate ratio of the difference between said gas count rate and said mixture count rate to the difference between said gas count rate and said liquid count rate $(C_{gas}-C_{mix})/(C_{gas}-C_{liquid})$.

5. The method of claim 3 wherein the step of determining a neutron log count rate ratio which relates volume fraction of said portion of said wellbore occupied by a liquid to a normalized neutron log count rate comprises determining a neutron log count rate ratio equal to $(M_{gas}-M_{mix})/(M_{gas}-M_{liquid})$.

6. The method of claim 1 wherein said neutron logging tool comprises a chemical neutron source and neutron detector.

7. The method of claim 6 wherein said chemical neutron source and said neutron detector are spaced about 17 inches apart.

8. The method of claim 1 wherein said neutron logging tool is an uncompensated neutron logging tool.

9. A method of quantifying gaseous fluid flow relative to liquid fluid flow in a portion of a wellbore having fluid flow layered according to density, said method comprising:

(a) obtaining calibration data which relates volume fraction of pipe occupied by a liquid to a normalized neutron log count rate;

(b) shutting in said wellbore;

(c) measuring a neutron log count rate for gaseous fluid ($M_{gas}$) in said portion of said wellbore with a neutron logging tool;

(d) measuring a neutron log count rate for liquid fluid ($M_{liquid}$) in said portion of said wellbore with said neutron logging tool;

(e) establishing fluid flow in said wellbore;

(f) measuring a neutron log count rate for flowing fluids ($M_{mix}$) over a logging interval of interest in said portion of said wellbore;

(g) determining a neutron log count rate ratio equal to $(M_{gas}-M_{mix})/(M_{gas}-M_{liquid})$; and (h) comparing said neutron log count rate ratio to said calibration data to quantify said gaseous fluid flow relative to said liquid fluid flow in said logging interval of interest.

10. The method of claim 9 wherein the step of obtaining said calibration data comprises correlating neutron log count ratios to relative quantities of said gas and said liquid in said pipe.

11. The method of claim 9 wherein the step of obtaining said calibration data comprises:

(a) measuring liquid count rate($C_{liquid}$) with a neutron logging tool in said pipe containing said liquid;

(b) measuring gas count rate ($C_{gas}$) with said neutron logging tool in said pipe containing said gas;

(c) measuring a plurality of mixture count rates ($C_{mix}$) with said neutron logging tool in said pipe for a plurality of known mixtures of said liquid and said gas; and (d) for each said known mixture of said liquid and said gas, determining a neutron log count rate ratio of the difference between said gas count rate and said mixture count rate to the difference between said gas count rate and said liquid count rate $(C_{gas}-C_{mix})/(C_{gas}-C_{liquid})$.

12. The method of claim 11 wherein said gas comprises air.

13. The method of claim 11 wherein said liquid comprises water.

14. The method of claim 11 wherein said pipe is surrounded by water-saturated sand bags.

15. A method of identifying a suitable location for performing a shut-off workover in a portion of a wellbore having fluid flow layered according to density, said method comprising:

(a) obtaining calibration data which relates volume fraction of pipe occupied by a liquid to a normalized neutron log count rate;

(b) while said wellbore is shut in, measuring a neutron log count rate for gaseous fluid ($M_{gas}$) in said portion of said wellbore;

(c) while said wellbore is shut in, measuring a neutron log count rate for liquid fluid ($M_{liquid}$) in said portion of said wellbore;

(d) while fluids are flowing in said wellbore, measuring a neutron log count rate for flowing fluids ($M_{mix}$) over a logging interval in said portion of said wellbore;

(e) determining a neutron log count rate ratio equal to $(M_{gas}-M_{mix})/(M_{gas}-M_{liquid})$;

(f) comparing the neutron log count rate ratio to said calibration data to obtain quantification data representative of said gaseous fluid flow relative to said liquid fluid flow in said logging interval; and (g) repeating steps (d) through (f) as necessary until said quantification data indicates that said logging interval is a suitable location for performing a shut-off workover.

* * * * *